US005413061A

United States Patent [19]

Smith

[11] Patent Number: 5,413,061

[45] Date of Patent: May 9, 1995

[54] MASTHEAD SPINNAKER HALYARD TURRET AND METHOD

[76] Inventor: Malcolm K. Smith, 362 Riverside Dr., Ormond Beach, Fla. 32176

[21] Appl. No.: 103,213

[22] Filed: Aug. 9, 1993

[51] Int. Cl.[6] ..... B63H 9/04

[52] U.S. Cl. ..... 114/105; 114/90; 114/102

[58] Field of Search ..... 114/90, 102, 103, 104, 114/105

[56] References Cited

U.S. PATENT DOCUMENTS

| | | | |
|---|---|---|---|
| 1,700,660 | 1/1929 | Williams . | |
| 3,415,215 | 12/1968 | Plym . | |
| 4,230,060 | 10/1980 | McCoy | 114/90 |
| 4,262,616 | 4/1981 | de Rougemont | 114/94 |
| 4,369,726 | 1/1983 | Mader | 114/90 |
| 4,526,122 | 7/1985 | Kluckhuhn | 114/106 |
| 4,690,088 | 9/1987 | Perini | 114/102 |
| 5,140,921 | 8/1992 | Howlett | 114/90 |

*Primary Examiner*—Jesus D. Sotelo
*Attorney, Agent, or Firm*—Allen, Dyer, Doppelt, Franjola & Milbrath

[57] ABSTRACT

A spinnaker halyard turret is affixed to a sail boat's masthead permitting a spinnaker halyard to be lead from within the mast through an exit tube at the top of the mast; then over a pair of sheaves aligned one forward of the other to a point on an arc beyond the perimeter of the mast. The turret has a crane which pivots freely in response to the load and direction of pull established by the sail on the halyard. The halyard maintains a fair lead over the sheaves to the head of the spinnaker sail. The arc through which the crane pivots in normal operation is controlled by limit stops to prevent twisting the halyards internally within the mast. The crane is mounted to a plate which pivots about the halyard exit tube. The plate and the exit tube are supported by bearing surfaces that minimize friction. With a second set of sheaves set adjacent and parallel to those described above, a second spinnaker halyard may be used to set a second spinnaker before the first spinnaker has been doused. With the turret, both halyards maintain their parallel alignment so that any number of subsequent sets and douses may be accomplished without the concern for crossed halyards.

20 Claims, 2 Drawing Sheets

MASTHEAD SPINNAKER HALYARD TURRET AND METHOD

BACKGROUND OF INVENTION

1. Field of Invention

The present invention relates to the nautical arts and in particular to an apparatus and method for controlling the fair lead of the spinnaker halyard from the masthead to the head of the spinnaker sail.

2. Description of Background Art

A spinnaker is a large, light, free flying balloon-line headsail used to improve a sailboat's down wind performance. It is generally used when running or when on a broad reach. The spinnaker is a three sided sail whose base is the foot of the sail. The top corner or head of the spinnaker is attached to a halyard that hoists the sail to one of the uppermost blocks on a mast. The leeward corner of the sail base is the clew which is attached to a sheet used to control the sail shape. A guy is attached to the weather or windward base corner called the tack. The tack is sometimes attached to the deck near the bow of cruising sailboats, but is more commonly attached to one end of a spinnaker pole that projects the sail outward to the side of the boat away from the mainsail where it is more effective. The inboard end of the spinnaker pole is attached to the mast. The weight of the pole is supported by a halyard called a topping lift.

In current practice, there are generally two recognized design concepts by which a spinnaker halyard is led from inside the modern mast to the spinnaker sail. One concept provides one or more sheaves set side-by-side within the mast on the foreside of the mast and immediately beneath the top of the mast. The halyards pass over these sheaves and exit through slots in the mast wall. The sides of the slots are rounded and in some cases covered with a plastic material to reduce friction and minimize chafe that occurs to the halyard in rubbing against these surfaces. In such designs, no attempt is made to maintain a fair lead from the sheaves to the head of the sail.

Another contemporary design provides for the halyards to exit the mast through slots in the mast wall several feet beneath the top of the mast. The exit slots are on the foreside of the mast to port and starboard of the centerline. Normally two halyards are used. The halyards lead upward from these slots to blocks suspended by shackles from fixed cranes. The cranes project forward of the mast and outward from the centerline. The blocks swing and pivot freely and normally allow a fair lead to the head of the sail. However, when a sail is jibed or a second sail is set on the lazy halyard before the first sail is lowered, a crossover of the halyards occurs preventing a repeat of spinnaker setting maneuvers unless proper alignment of the halyards is reestablished. This may mean sending a sailor to the top of the mast to uncross the halyards.

U.S. Pat. No. 5,140,921 issued on Aug. 25, 1992 to Ian C. Howlett discloses a mast provided with guide means for halyards. Howlett '921 teaches means for guiding halyards within a hollow mast and for maintaining them in spaced apart relationship. Support is clearly given to the need for maintaining halyards in good condition by reducing wear or entanglement.

U.S. Pat. No. 4,690,088 issued on Sep. 1, 1987 to Fabio Perini discloses a sail rigging with fairing which envelopes the mast and provides a smooth continuum of an air foil from the leading edge of the fairing around and behind the mast and into the body of the sail so as to avoid eddy currents and air flow interruption across the continuum of the sail and mast. Perini '088 discloses support at the top of the mast for anchoring the fore and aft stays. The masthead has two transmission pulleys for a halyard which extends through the inside of the mast and passes through a central opening over the pulley for engaging the top of the sail and lifting same. It is noted that Perini '088 points out that although sailing craft designs have improved over the early years with a competitive factor becoming increasing important in commercial considerations, it was not until non-commercial activities such as the "America's Cup Race" that much time and attention was given to the highly technical aspects of sailboat design. Perini '088 points out that a great deal of time, effort and dollars have been spent on developing even the smallest details of the ships, their sails, and their designs and construction showing that any improvement which could give even a small edge in competitive race was important.

There is a need for maintaining a fair lead for a halyard from the mast to the head of the spinnaker sail. There is a need to provide such a lead so as to have the halyard be responsive to the load of the sail without the concern of chafing or wearing of the halyard. There is a need to be able to set a second spinnaker prior to dousing the first spinnaker to be flown. And there is a further need to accomplish repetitive set and douse maneuvers without tangling the halyards or causing them to cross over and around each other. And particularly on cruising sail boats where only a single spinnaker halyard may be employed, there is a need to be able to use that one halyard in either a port or starboard set, subsequently jibe and ultimately lower the sail without encountering the problems now routinely faced with a spinnaker sock (dousing device) fouled across the forestay as a result of the jibe. It is these needs that have not previously been addressed and are thus addressed by the present invention.

BRIEF SUMMARY OF INVENTION

The present invention provides a masthead spinnaker halyard turret comprising a means for guiding a halyard from within a mast to a position outboard of the mast. The guiding means maintains the halyard within a plane on an arc outside the perimeter of the mast. Means for rotating the plane about an axis of the mast provides a continuous fair lead from the masthead to the head of the spinnaker. The rotating means is responsive to forces from the spinnaker head. In addition, means for restricting the rotation of the plane to within a predetermined range of arc about the axis is provided.

In the preferred embodiment of the invention, the guiding means comprises a plate adapted to be affixed to a masthead. The plate has an aperture for receiving a halyard from within a mast. A crane having a fore end and aft end, the crane having parallel side walls separated for receiving sheaves, is affixed to the plate. An aft sheave is rotatably affixed between the side walls, the aft sheave positioned for receiving the halyard from the plate aperture. A fore sheave is rotatably affixed between the side walls, the fore sheave positioned to extend the halyard outboard of the mast.

The preferred embodiment further comprises a base plate configured to be affixed to a masthead. The base plate has an aperture for receiving a halyard from within the mast. The base plate has a circular groove on one surface for receiving bearings. The groove extends around the aperture. A rotatable plate is rotatably affixed to the base plate. The rotatable plate has a first surface affixed to the guiding means. The rotatable plate has an aperture for receiving a halyard. The rotatable plate aperture is positioned to cooperate with the base plate aperture. The rotatable plate has a circular groove. The rotatable plate groove also extends around the aperture for cooperating with the base plate groove. The grooves are positioned for receiving bearings which are placed between the base plate and the rotatable plate. The bearings are sized for cooperating with the grooves. The rotatable plate rests upon the bearing surface that minimizes friction, permitting it to pivot freely.

In the preferred embodiment, the restricting means comprises a first stop affixed to the rotatable plate. The first stop extends from the rotatable plate surface toward the base plate. A pair of stops is affixed to the base plate. The base plate stop pair extends toward the rotatable plate. The base plate stops are affixed at locations to limit the rotation of the plate about the axis through which the halyard exits the masthead.

In an alternate embodiment of the invention, the fore and aft sheaves are multiple fore and aft sheaves for handling multiple halyards. In the preferred embodiment, sheaves for handling two halyards is taught.

A method for continuously maintaining a fair lead to a spinnaker halyard is taught which comprises the steps of guiding a halyard from within a mast to a position outboard of the mast. The halyard is maintained in alignment within a plane. Multiple halyards are maintained within their respective multiple planes. A step includes rotating the plane about an axis of the mast as the plane rotation responds to forces from the spinnaker head to which the halyard is affixed. Restricting the rotation of the plane to within a predetermined range of arc about the axis is employed.

It is an object of the invention to improve the lead of the spinnaker halyard from the mast to the sail and to resolve the complications that result when halyards are crossed over one another when a sail is jibed or when another spinnaker is set to replace the first one to be flown.

It is another object of the invention to provide a fair lead from a mast to a first sail while permitting a second sail to be properly set and a takedown of the first sail properly and efficiently completed without concern that the second sail will be flown on a crossed halyard, thereby preventing a repeat of the maneuver.

It is yet another object of the invention to respond to the load of the spinnaker sail and maintain alignment to the head of the spinnaker sail during a jibe without placing unnecessary limitations on the set and douse of other spinnakers.

DETAILED DESCRIPTION OF PREFERRED EMBODIMENT

For purposes of illustrating the invention, a spinnaker halyard turret, a preferred embodiment configured for handling dual halyards is described and shown in the accompanying drawings. It is understood that alternate embodiments for use with a single halyard or multiple halyards will be obvious to those of ordinary skill in the art.

Figure 1:
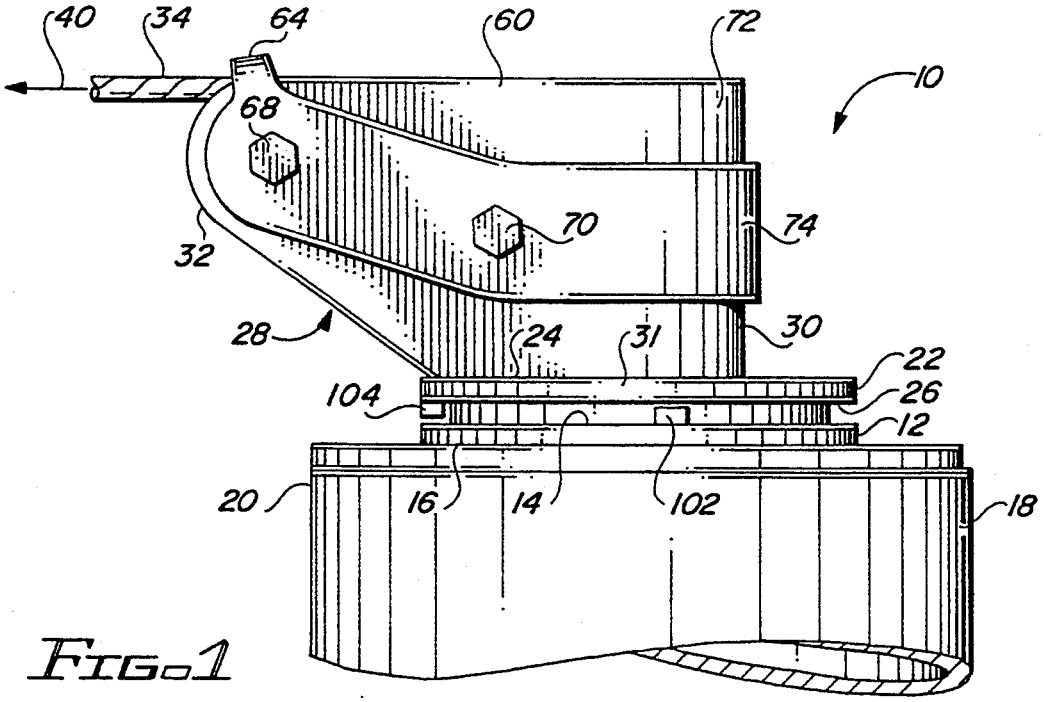
FIG. 1 is a side view of the spinnaker halyard turret illustrating its position on a masthead, crane configuration extending a halyard beyond the mast, and stops used to limit rotation of the crane.
Figure 2:
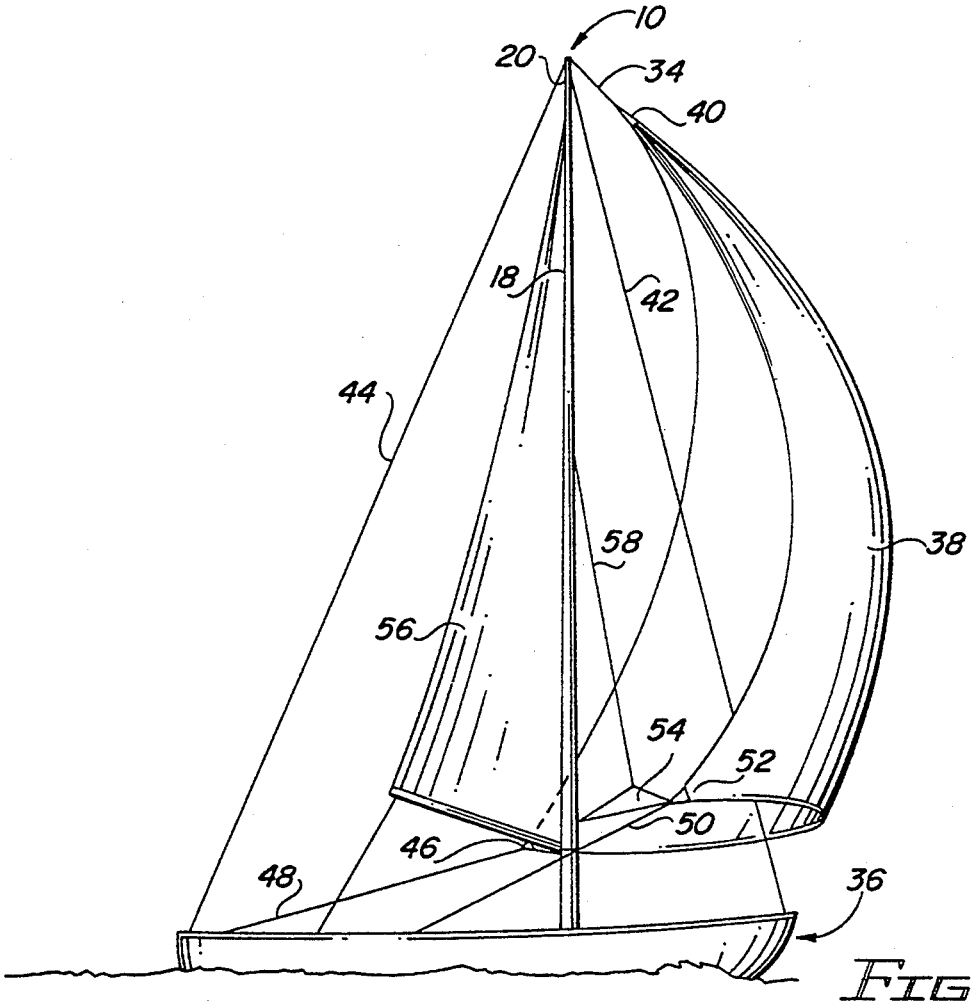
FIG. 2 is a partial perspective view of a boat under sail wherein a spinnaker is flown from the masthead using the spinnaker halyard turret for maintaining a fair lead for the spinnaker head.

The spinnaker halyard turret 10 as illustrated in FIG. 1 comprises a base plate 12 having a first surface 14 and a second surface 16. The base plate 12 is affixed to a mast 18 at the masthead 20. A rotatable plate 22 having a first surface 24 and a second surface 26 is rotatably affixed to the base plate 12. The details of affixing the base plate 12 to the rotatable plate 22 are addressed later in this section of the specification. A crane 28 having an aft end 30 and a fore end 32 is affixed to the rotatable plate first surface 24 at its aft end 30 along its lower surface 31. In the preferred embodiment, the method of affixing the crane 28 to the rotatable plate 22 is with a continuous bead weld for turrets fabricated from stainless steel. Again with reference to FIG. 1, a halyard 34 is led outboard of the mast 18 and toward a spinnaker head as is further illustrated in FIG. 2. FIG. 2 is a perspective view of a sailboat flying a spinnaker 38 from the masthead 20 using the spinnaker halyard turret 10. A fairlead is maintained between the masthead 20 and the spinnaker head 40 using the turret 10 for extending the halyard 34 out and away from other rigging typically found on a sailboat such as a jibe forestay 42.

As was described in the background section of this specification, The spinnaker 38 is a three sided sail whose base is the foot of the sail. The top corner of the triangle or head 40 of the spinnaker 38 is attached to the halyard 34 that hoists the sail to one of the uppermost blocks of the mast 18. The leeward corner of the sail base is the clew 46 which is attached to a sheet 48 used to control the sail shape. A guy 50 is attached to the weather or windward base corner of the spinnaker 38 called the tack 52. The tack 52 is sometimes attached to the deck near the bow of cruising sailboats, but is more commonly attached to one end of a spinnaker pole 54 that projects the sail 38 outward to the side of the boat away from the mainsail 56 where it is more effective. The second end of the spinnaker pole 54 is attached to the mast 18. The weight of the pole 54 is supported by a halyard 58 called a topping lift, attached to the mast 18 and the pole 54.

Figure 3:
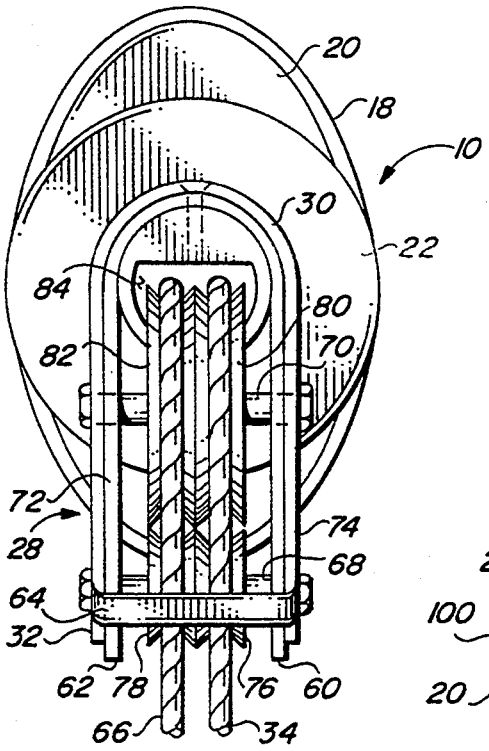
FIG. 3 is a top view of a preferred embodiment of the turret operating with two spinnaker halyards illustrating forward and aft sheaves used in guiding the halyards outboard of the mast.
Figure 4:
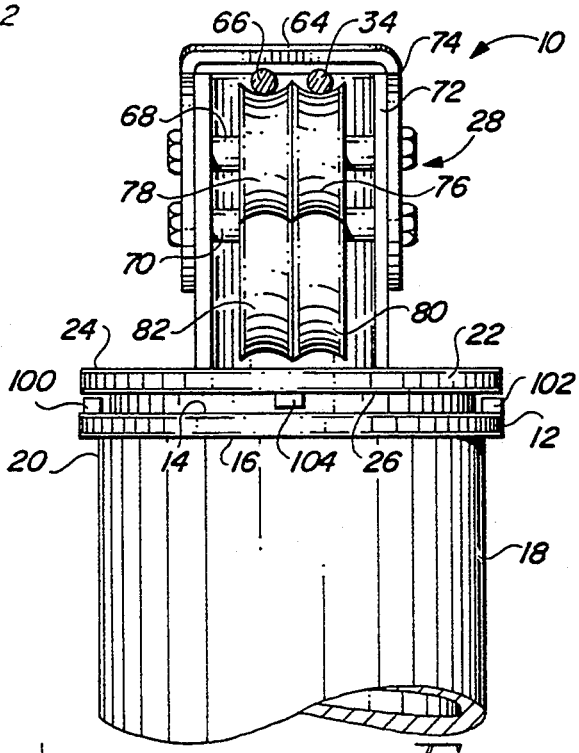
FIG. 4 is a front view of the embodiment illustrated in FIG. 3 further illustrating the turret structure including the arrangement of the sheaves rotatably affixed within the crane and the rotational stops affixed to the turret plates.

In a preferred embodiment of the invention, the turret 10 is configured to handle two halyards. FIG. 3 illustrates this embodiment in a top view of the turret 10. FIG. 4 illustrates this embodiment with a front view. With reference to FIGS. 1, 3 and 4, it can be seen that the crane 28 comprises parallel side walls 60 and 62 separated for receiving sheaves. The aft end 30 is affixed to the rotatable plate 22 as described earlier and the crane fore end 32 has a crane spacer member 64 having one end of the member 64 affixed to one wall 60 and the other end of the member 64 affixed to the second wall 62. The member 64 adds stability to the crane 28 and provides the added assurance that the wall 60 is maintained as a fixed position with respect to the wall 62 during the applied forces from the spinnaker 38 through the halyard 34 or second halyard 66 in the case of the dual halyard turret 10. In addition, member 64 contains the halyards so that they cannot climb or be lifted from sheaves. The walls 60 and 62 are also held in their parallel positions by a fore sheave shaft 68 and an aft sheave shaft 70 affixed between the walls. In the embodiment described herein, the crane 28 comprises a "U" shaped structure fabricated by forming a plate 72 so that the arm portions of the "U" form the parallel walls 60 and 62 and the rounded portion of the "U" forms the crane aft end 30 which is affixed to the rotatable plate 22. The "U" shape is arbitrary but has proven to be a preferred crane 28 structure as of this writing. For added support to the crane walls 60 and 62, and for providing strength to the walls at the locations where the shafts 68 and 70 are affixed to the walls, a second plate 72 is formed around the "U" as is illustrated in FIGS. 1 and 3.

Again with reference to FIGS. 3 and 4, a fore sheave 76 is rotatably affixed to the fore sheave shaft 68. For the dual halyard turret embodiment described, a second fore sheave 78 is rotatably affixed on the fore sheave shaft 68. The sheaves 76 and 78 rotating independently from each other. In a similar manner, aft sheaves 80 and 82 are rotatably affixed to the aft sheave shaft 70. The size of the aft sheaves 80 and 82 in combination with the location of the aft sheave shaft 70 are such that the sheaves 80 and 82 freely receive halyards coming from within the mast 18 and through the masthead 20, base plate 12, and rotatable plate 22. Apertures 84 are contained in the masthead and plates to accommodate the free passing of halyards from within the mast be to the aft sheaves 80 and 82 as is illustrated in FIG. 3 of the enclosed drawings. The fore sheaves 76 and 78 are sized for receiving the halyards 34 and 66 and the fore sheave shaft 68 positioned so that the halyards 34 and 66 are led outboard of the mast 18.

Figure 5:
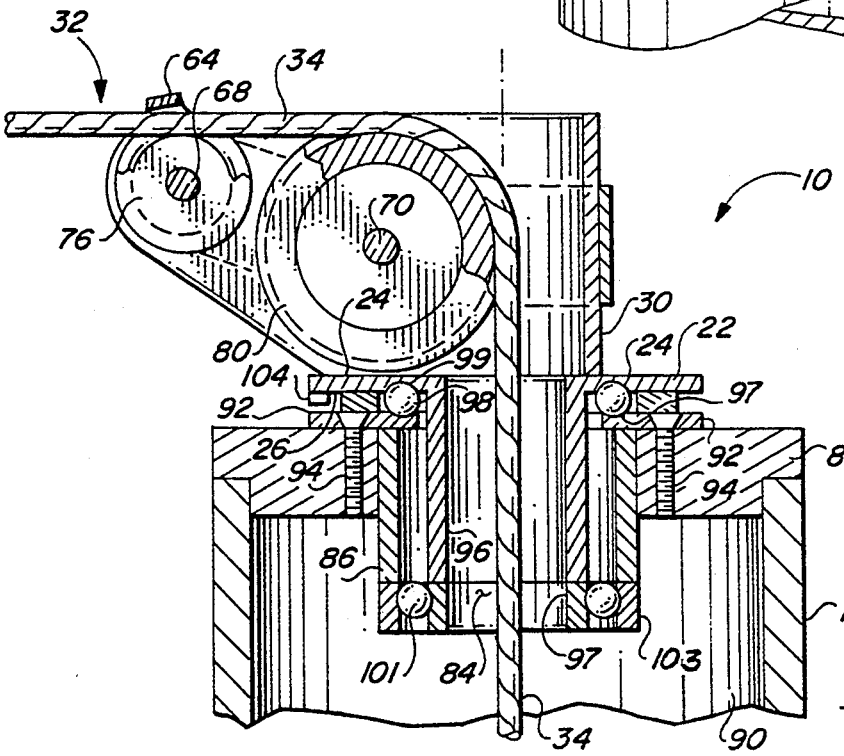
FIG. 5 is a partial cross-sectional view of the preferred embodiment illustrating the arrangement of the top plate rotatably affixed the base plate and the halyard passing from the halyard exit tube through the plates and over the sheaves to beyond the mast.

As described earlier in this section of the specification, the base plate 12 is affixed to the masthead 20 and the rotatable plate 22 is rotatably affixed to the base plate 12. In the preferred embodiment, regardless of the number of sheaves and halyards being accommodated, the base plate comprises a cylindrical extension 86 affixed to the second surface 16 which extends through the masthead top plate 88 and into the mast chamber 90. The extension 86 has a diameter less that the base plate 12 and as a result, a flange 92 is formed at the juncture of the base plate 12 and the extension 86. In the preferred embodiment, mounting bolts 94 are used to affix the base plate 12 to the masthead top plate 88 at the flange 92 as is illustrated in FIG. 5 containing a partial cross-sectional side view of the turret 10. With continued reference to FIG. 5, the rotatable plate 22 likewise comprises a cylindrical extension 96 integrally affixed to the rotatable plate second surface 26 and is dimensioned to fit within the base plate extension 86 by passing through the aperture 84 within the base plate 12. The extension 96 forms a halyard exit tube 97 for the halyard 34 passing from the mast chamber 90 and out through the masthead 88. Grooves are formed in the facing surfaces of the base plate 12 and the rotatable plate 22 respectively. The grooves 97 and 99 form circles passing around the apertures 84 and are located to cooperate with each other while allowing bearings 98 to freely roll within the grooves as is illustrated in FIG. 5.

Again with reference to the partial cross-sectional view of the turret 10 of FIG. 5, the halyard 34 is guided from within the mast chamber 90 through the exit tube 97 and apertures 84 of the base plate 12 and the rotatable plate 22 to the aft sheave 80. The aft sheave 80 rotatably guides the halyard 34 for receipt by the fore sheave 76 where the fore sheave places the halyard 34 beyond the mast 18. By permitting the crane 28 to freely rotate in response to forces from the spinnaker head 40 to which the halyard 34 is affixed, a fairlead is continuously maintained for the spinnaker and as can be appreciated an important object of the invention is successfully met.

Within the preferred embodiment, an alternate set of bearings in the form of caged roller bearing are fitted between the cylindrical extensions 86 and 96 or plate bearing 101 are fitted within a bearing plate 103 communicating between the cylindrical extensions 86 and 96 as illustrated in FIG. 5. The extension 86 of the base plate 12 act as an inner bearing race while the extension 96 of the rotatable plate 22 acts as an outer bearing race. Such low friction means such as the grooves (97 and 99) and bearings 98, the caged roller bearing and the bearing plate 103 and bearings 103 can all be used or used in varying combination. In the preferred embodiment, the plate grooves 97 and 99 with bearings 98 are used in combination with the bearing plate 103 and bearings 101.

It is desirable to limit the rotation of the crane 28 to avoid twisting the halyards 34 and 66 internally within the mast 90 where such might occur as the result of extraordinary circumstances encountered in a sudden violent windshift, broach or other loss of control. In the preferred embodiment, stops are used to limit the rotation to a point on the starboard side of the mast and a second point on the port side of the mast. Again with reference to FIG. 4, the base plate 12 has a starboard stop 100 affixed onto the base plate first surface 14 and a second stop or a port stop 102 affixed to the base plate first surface 14. In the preferred embodiment, these stops 100 and 102 are approximately 180° away from each other but can be adjusted to suit the needs of a particular sailor and sail boat. The stops 100 and 102 extend from the base plate first surface 14 towards the rotatable plate second surface 26. Extending from the rotatable plate second surface is a third stop 104 which extends from the rotatable plate second surface 26 toward the base plate first surface 14. The third stop 104 is affixed for rotation between an extreme first position against the starboard stop 100 and an extreme second position against the port stop 102. With such a configuration, the rotatable plate 22 will be limited to rotation towards the starboard side when the third stop 104 is met by the starboard stop 100. In a similar manner rotation to the port side will be limited when the third stop 104 is met by the port stop 102.

The above described invention focused on a single halyard and on the preferred embodiment for dual halyards but it can be appreciated that multiple halyards can be directed outboard of a mast and fair leads maintained for such halyards using the spinnaker halyard turret. In other words, it is to be understood that the present invention may be embodied in other specific forms without departing from the spirit or special attributes herein described. It is therefore desired that the present embodiments be considered in all respects as to the foregoing description to indicate the scope of the invention and not as being restrictive reference made to the appended claims.

What is claimed is:

1. A masthead spinnaker halyard turret, comprising:

means for guiding a halyard from within a mast to a position outboard of the mast and any standing rigging, the guiding means maintaining the halyard within a plane;

means for rotating the plane about an axis of the mast, the rotating means providing a continuous fair lead to the spinnaker, the rotating means responsive to a force from the spinnaker head; and means for restricting the rotation of the plane to within a predetermined range of arc about the axis.

2. The turret as recited in claim 1, wherein the guiding means comprises:

a plate adapted to be affixed to a masthead, the plate having an aperture for receiving a halyard from within a mast;

a crane having a fore end and aft end, the crane having parallel side walls separated for receiving sheaves, the crane aft end integrally affixed to the plate;

an aft sheave rotatably affixed between the side walls, the aft sheave positioned for receiving the halyard from the plate aperture; and a fore sheave rotatably affixed between the side walls, the fore sheave positioned to extend the halyard outboard of the mast and any standing rigging.

3. The turret as recited in claim 2, wherein the aft sheave comprises a multiple aft sheave for receiving multiple halyards and the fore sheave comprises a multiple fore sheave for receiving the multiple halyards from the multiple aft sheave and positioning the multiple halyards outboard of the mast.

4. The turret as recited in claim 1, wherein the rotating means comprises:

a base plate configured to be affixed to a masthead, the base plate having an aperture for receiving a halyard from within a mast, the base plate having a circular groove on one surface for receiving bearings, the groove extending around the aperture;

a rotatable plate rotatably affixed to the base plate, the rotatable plate having a first surface affixed to the guiding means, the rotatable plate having an aperture for receiving a halyard, the rotatable plate aperture positioned to cooperate with the base plate aperture, the rotatable plate having a second surface, the second surface having a circular groove, the groove extending around the aperture so as to cooperate with the base plate groove, the groves positioned for receiving bearings;

bearings placed between the base plate and the rotatable plate, the bearings sized for cooperating with the grooves.

5. The turret as recited in claim 4 further comprising:

a first stop affixed to the rotatable plate, the first stop extending from the rotatable plate second surface toward the base plate; and a pair of stops affixed to the base plate, the base plate stops extending from the grooved surface toward the rotatable plate, the base plate stops affixed at locations to permit rotation of the plates through a partial revolution about the axis of the mast.

6. A masthead spinnaker halyard turret, comprising:

a masthead base plate, the base plate having an aperture for passing a halyard, the plate configured for attaching to a top portion of a mast;

a rotatable plate having an aperture, the rotatable plate rotatably affixed to the masthead base plate wherein the apertures cooperate to receive the halyard and freely pass therethrough;

a crane having a fore end and an aft end, the crane aft end affixed to the rotatable plate;

a first sheave rotatably affixed to the crane proximate to the crane aft end, the sheave positioned for freely receiving the halyard from the plate apertures, the halyard being fed from within the mast;

a second sheave rotatably affixed to the crane proximate to the crane fore end, the sheave positioned for freely extending the halyard outboard of the mast and any standing rigging; and means for affixing the base plate to the masthead.

7. The turret as recited in claim 6, wherein rotatably affixing the plates further comprises:

a surface of the rotatable plate having a circular groove, the groove extending around the aperture;

a surface of the base plate having a circular groove, the groove extending around the aperture, the base plate groove cooperating with the rotatable plate groove, the grooves dimensioned to receive bearing elements; and bearing elements positioned between the rotatable plate and the base plate, the bearing elements confined for rotation within the groves.

8. The turret as recited in claim 7 further comprising:

a first cylindrical extension affixed to the base plate, the extension dimension to penetrate a masthead;

a second cylindrical extension affixed to the rotatable plate, the second extension passing within the first extension so as to form a gap between the first and second extensions; and a bearing rotatably affixed within the gap.

9. The turret as recited in claim 6, wherein the first sheave comprises a first sheave pair, the second sheave comprises a second sheave pair, the sheave pairs cooperating to receive a first halyard and a second halyard.

10. The turret as recited in claim 6, wherein the crane further comprises:

side walls, the side walls positioned for receiving the sheaves between the walls;

a first shaft affixed between the side walls, the first sheave rotatably about the first shaft; and a second shaft affixed between the side walls, the second sheave rotatable about the second shaft, the first and second shafts affixed to maintain the side walls parallel to each other.

11. The turret as recited in claim 10, further comprising a crane spacer member affixed between the walls to contain the halyard between the walls and the sheaves.

12. A masthead spinnaker halyard turret, comprising:

a base plate, the base plate having an aperture for receiving a halyard from within a mast, the base plate having a cylindrical extension member for extending into the mast, the base plate having a flange portion configured to be affixed to a masthead, the masthead having an aperture adapted for receiving the base plate, the base plate having a circular groove on one surface configured for receiving bearings, the groove extending around the aperture;

a rotatable plate rotatably affixed to the base plate, the rotatable plate having a first surface and a second surface, the rotatable plate having a cylindrical member extending from the rotatable plate second surface dimensioned to be received by the base plate extension member, the rotatable plate having an aperture for receiving a halyard, the rotatable plate extension member positioned to cooperate with the base plate extension member, the rotatable plate extension member rotatable within the base plate extension member, the rotatable plate second surface having a circular groove, the groove extending around the aperture so as to cooperate with the base plate groove, the groves positioned for receiving bearings;

bearings positioned between the rotatable plate and the base plate, the bearings confined for rotation within the groves;

a crane having parallel walls, the walls having an aft end and a fore end, the aft end affixed to the rotatable plate first surface, the walls separated for receiving sheaves;

a first shaft affixed between the crane walls, the first shaft affixed proximate to the crane aft end;

a first sheave dimensioned to freely receive the halyard passing from within the mast through the apertures, the first sheave pivotable about the first shaft;

a second shaft affixed between the crane walls, the second shaft affixed proximate to the crane fore end;

a second sheave dimensioned to extend the halyard outboard of the mast, the second sheave pivotable about the second shaft;

a member affixed between the crane walls, the spacer member serving to contain the halyard between the walls and the sheaves; and the crane pivotal in response to a force from a spinnaker head affixed to the halyard, whereby a fair lead is maintained for the halyard.

13. The turret as recited in claim 12, wherein the first sheave comprises a first sheave pair and the second sheave comprises a second sheave pair, the first sheave pair cooperating to freely receive a first and second halyard through the apertures from within the mast, and the second sheave pair cooperating to extend the first and second halyards outboard of the mast while maintaining a separation between the halyards.

14. The turret as recited in claim 12, further comprising bearings rotatably affixed within a gap formed between walls of the base plate extension and rotatable plate extension.

15. A method for continuously maintaining a fair lead to a spinnaker halyard comprising the steps of:

guiding a halyard from within a mast to a position outboard of the mast;

maintaining the halyard within a plane;

rotating the plane about an axis of the mast, the plane rotation responding to a force from the spinnaker head; and restricting the rotation of the plane to within a predetermined range of arc about the axis.

16. The method as recited in claim 15, wherein the guiding step and maintaining the halyard within a plane further comprise the steps of:

providing a plate dimensioned to attach to a masthead, the plate having an aperture for receiving a halyard from within a mast;

affixing the plate to the masthead;

providing a crane having a fore end and aft end, the crane having parallel side walls separated for receiving sheaves;

affixing the crane aft end to the plate;

providing an aft sheave;

positioning the aft sheave for receiving the halyard from the plate aperture;

rotatably affixing the aft sheave between the side walls;

providing a fore sheave;

positioning the fore sheave for extending the halyard outboard of the mast; and rotatably affixing the fore sheave between the side walls.

17. The method as recited in claim 15, wherein the step of rotating the plane further comprises the steps of:

providing a base plate having first and second surfaces;

affixing the base plate second surface to the masthead;

providing an aperture in the base plate extending through the first and second surfaces, the aperture sized for freely receiving the halyard from within a mast;

providing a circular groove on the first surface of the base plate for receiving bearings;

extending the groove around the aperture;

providing a rotatable plate having a first surface and a second surface;

affixing the guiding means to the rotatable plate first surface;

providing an aperture extending through the first and second surfaces in the rotatable plate for freely receiving the halyard;

positioning the rotatable plate aperture for cooperating with the base plate aperture;

providing a circular groove in the rotatable plate second surface having a circular groove, the groove extending around the aperture so as to cooperate with the base plate groove;

positioning the grooves for receiving bearings;

providing a plurality of bearings;

placing the bearings between the base plate and the rotatable plate for cooperating with the grooves; and leading the halyard from within the mast through the apertures for cooperating with the guiding means.

18. The method as recited in claim 17, further comprising the steps of:

providing a first stop;

affixing the first stop to the rotatable plate;

extending the first stop from the rotatable plate toward the base plate;

providing a pair of stops;

affixing the stop pair to the base plate;

extending each stop of the stop pair from the base plate toward the rotatable plate; and affixing the stop pair at locations to limit rotation of the plates through a partial revolution about an axis of the mast, the rotation resulting from changes in direction of the halyard.

19. The method as recited in claim 17, further comprising the steps of:

providing a first cylindrical extension, the extension having a bore passing therethrough;

affixing the first cylindrical extension to the base plate;

passing the first extension through a masthead;

providing a second cylindrical extension having a bore therethrough;

affixing the second extension to the rotatable plate;

positioning the second extension for rotating within the first extension bore, the first extension and second extension separated by a gap;

providing bearings sized for rotating within the gap; and rotatably affixing the bearing within the gap.

20. The method as recited in claim 15, wherein the guiding step and maintaining the halyard within a plane further comprise the steps of:

providing a plate dimensioned to attach to a masthead, the plate having an aperture for freely receiving multiple halyards from within a mast;

affixing the plate to the masthead;

providing a crane having a fore end and aft end, the crane having parallel side walls separated for receiving sheaves;

affixing the crane aft end to the plate;

providing multiple aft sheaves;

positioning each of the aft sheaves for receiving a preselected halyard from the multiple halyards through the plate aperture;

rotatably affixing the aft sheaves between the side walls;

providing multiple fore sheaves for cooperating with the multiple aft sheaves;

positioning the fore sheaves for extending each of the multiple halyards outboard of the mast; and rotatably affixing the fore sheaves between the side walls.

* * * * *